US008020735B2

(12) United States Patent
Chang

(10) Patent No.: US 8,020,735 B2
(45) Date of Patent: Sep. 20, 2011

(54) DETACHABLE THREADER

(76) Inventor: Pi-Chao Chang, Taichung County (TW)

( * ) Notice: Subject to any disclaimer, the term of this patent is extended or adjusted under 35 U.S.C. 154(b) by 402 days.

(21) Appl. No.: 12/379,318

(22) Filed: Feb. 19, 2009

(65) Prior Publication Data

US 2010/0206206 A1 Aug. 19, 2010

(51) Int. Cl.
*D05B 87/00* (2006.01)

(52) U.S. Cl. ..... 223/99

(58) Field of Classification Search ..... 223/99, 223/1; 112/224, 225
See application file for complete search history.

(56) References Cited

U.S. PATENT DOCUMENTS

| | | | | | |
|---|---|---|---|---|---|
| 2,195,571 | A * | 4/1940 | Jauch | 223/99 |
| 2,338,159 | A * | 1/1944 | Appleton | 223/99 |
| 2,490,883 | A * | 12/1949 | Pinkham et al. | 223/99 |
| 2,679,959 | A * | 6/1954 | Ullisperger, Sr. et al. | 223/99 |
| 2,777,623 | A * | 1/1957 | Balzer | 223/99 |
| 4,911,341 | A * | 3/1990 | Davis | 223/99 |
| 4,913,325 | A * | 4/1990 | Cacicedo | 223/99 |
| 6,045,016 | A * | 4/2000 | Okada | 223/99 |
| 6,170,722 | B1 * | 1/2001 | Huang | 223/99 |
| 6,830,165 | B2 * | 12/2004 | Tanaka | 223/99 |
| 7,444,949 | B2 * | 11/2008 | Park et al. | 112/225 |
| 2010/0206206 | A1 * | 8/2010 | Chang | 112/225 |

* cited by examiner

*Primary Examiner* — Danny Worrell
(74) *Attorney, Agent, or Firm* — C. G. Mersereau; Nikolai & Mersereau, P.A.

(57) ABSTRACT

The present invention provides a detachable threader, which permits an upper holder block to be connected separately with a brake and a base; and the brake is linked with a propeller; a threading sheet is fixed on the propeller; with the orientation pin and restoring spring on the base, the upper holder block can be controlled in a manner to make the threading sheet move freely in the threading groove of the needle stand; additionally, a V-shaped groove is arranged at the bottom of the adapting hole; after the needle is inserted into the adapting hole, it can align automatically the needle hole with the threading groove; moreover, the base is linked with the detachable pedestal, wherein the inner space with an oblique surface is used to accommodate the needle and stitch.

6 Claims, 11 Drawing Sheets

DETACHABLE THREADER

BACKGROUND OF INVENTION (1) Field of the Invention

The present invention relates generally to a detachable threader, and more particularly to an innovative one which permits rapid threading into the needle hole by a push-type threading mechanism, and also provides a space for collecting the needle and thread.

(2) Description of the Prior Art

Referring to FIG. 1, a conventional threading device 10 has a wider handheld portion 11, at front end of which there is a rhombic flexible steel wire 12. The flexible steel wire 12 is used for threading into the needle hole 14 of the needle 13 and also for threading of the stitch after passing through the needle hole 14.

With this device, the users can align the flexible steel wire 12 of the threading device 10 with the needle hole 14 of the needle 13 and then pass through it, then, let the stitch thread the flexible steel wire 12; take out the flexible steel wire 12 from the needle hole 14, then the stitch is threaded into the needle hole 14.

However, the conventional threading device has the following shortcomings with respect to the structural design and operation:

Firstly: the rapid threading is made possible provided that the user lets the flexible steel wire pass through the needle hole; however, such a threading job is very difficult since both flexible steel wire and needle hole are rather tiny.

Secondly: the tiny flexible steel wire may generate deformation or even fracture after a period of time.

Additionally, the tiny needle and threading device may be easily lost during storage.

SUMMARY OF THE INVENTION

Thus, to overcome the aforementioned problems of the prior art, it would be an advancement in the art to provide an improved utility model of detachable threader that features convenient operation as shown in FIG. 2.

A detachable threader, which comprising: an upper holder block, a brake, a needle stand, a propeller, a base and a detachable pedestal; when the upper holder block presses down, and the propeller is driven through the brake, the threading sheet on the brake may move forward within the threading groove of the needle stand, so that the stitch is penetrated into the needle hole for rapid threading operation.

The main objective and efficacy of the present invention is to move the propeller smoothly and efficiently by conducting the kinetic energy of the upper holder block through the brake.

The second objective and efficacy of the present invention is to mount a V-shaped groove at the bottom of the adapting hole of the needle stand, which, after the needle is inserted into the adapting hole, can align automatically the needle hole with the threading groove, ensuring that the stitch can pass through the needle hole smoothly in every threading operation.

The third objective and efficacy of the present invention is to arrange an oblique holder space in the detachable pedestal for easy access to the needle and thread; and, the detachable pedestal is linked with the base, enabling the user to conduct convenient threading operation.

DETAILED DESCRIPTION OF THE PREFERRED EMBODIMENTS

The features and the advantages of the present invention will be more readily understood upon a thoughtful deliberation of the following detailed description of a preferred embodiment of the present invention with reference to the accompanying drawings.

Figure 1:
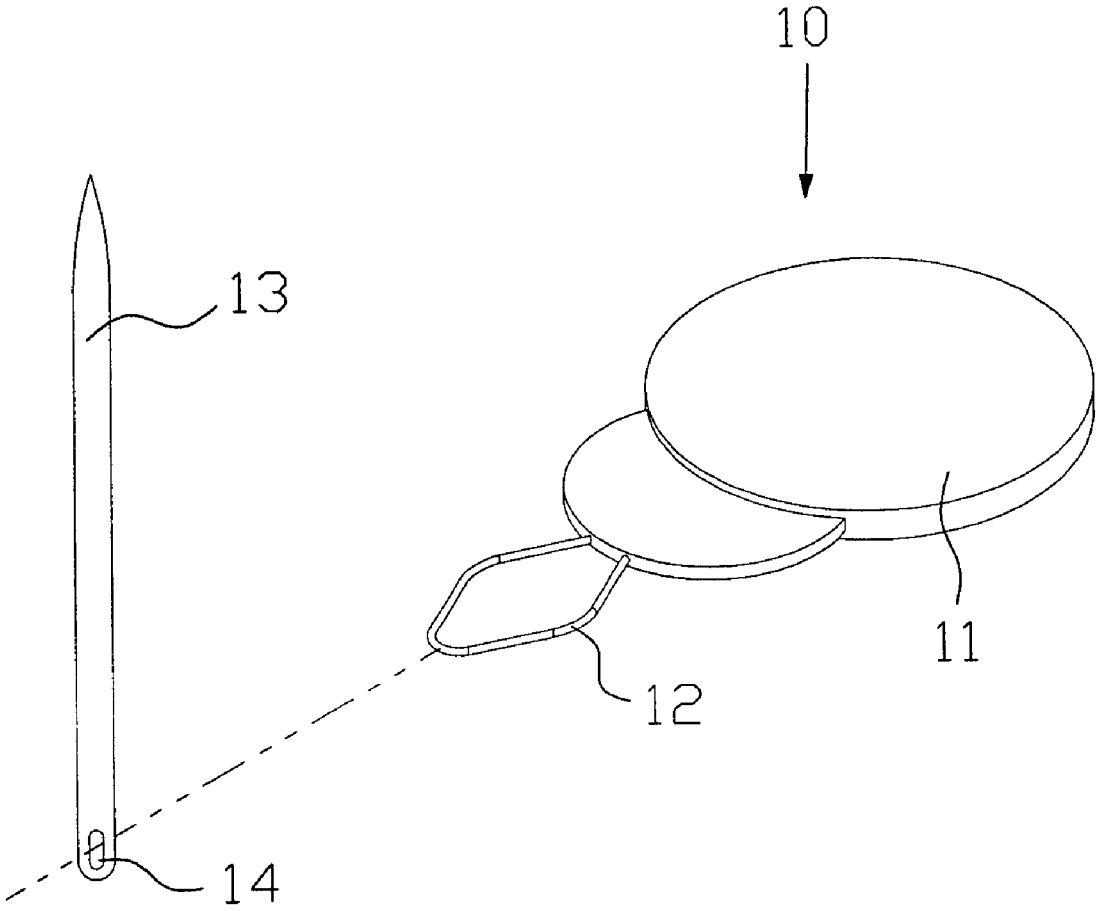
F I G. 1 (PRIOR ART)
FIG. 1 shows an operation view of typical threading device.
Figure 2:
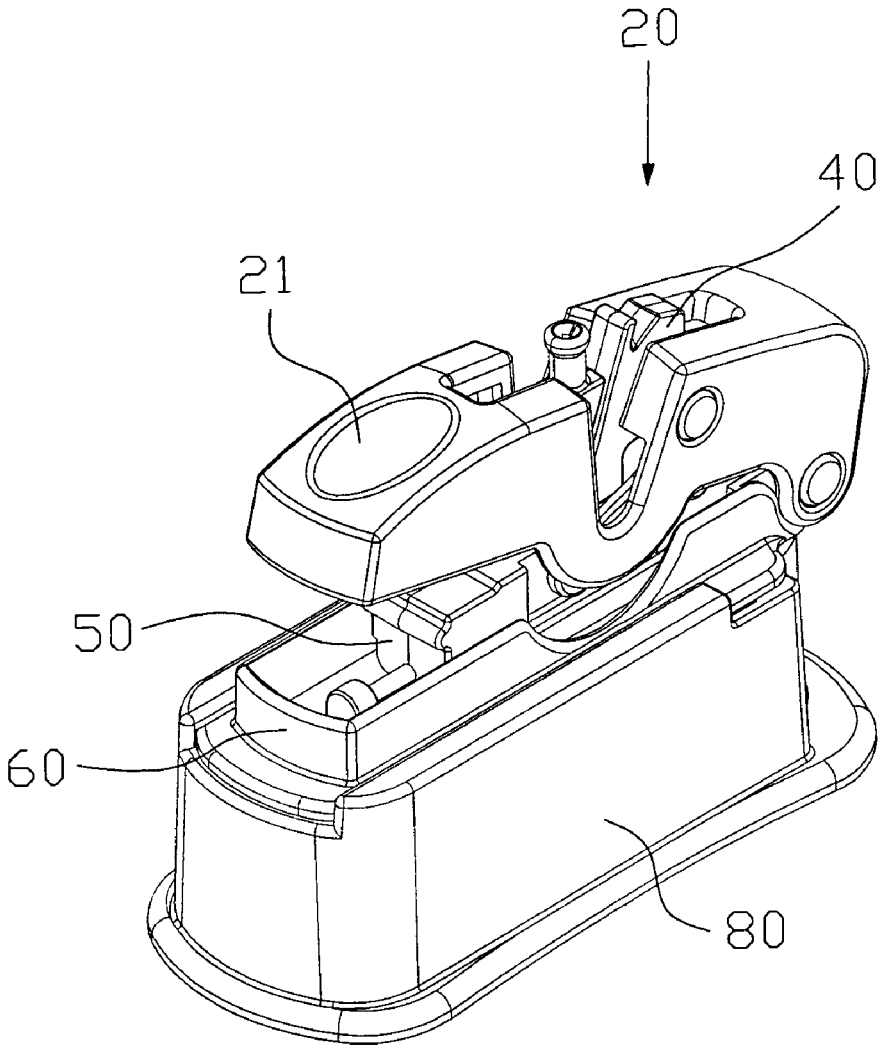
FIG. 2 shows a perspective view of the present invention.
Figure 3:
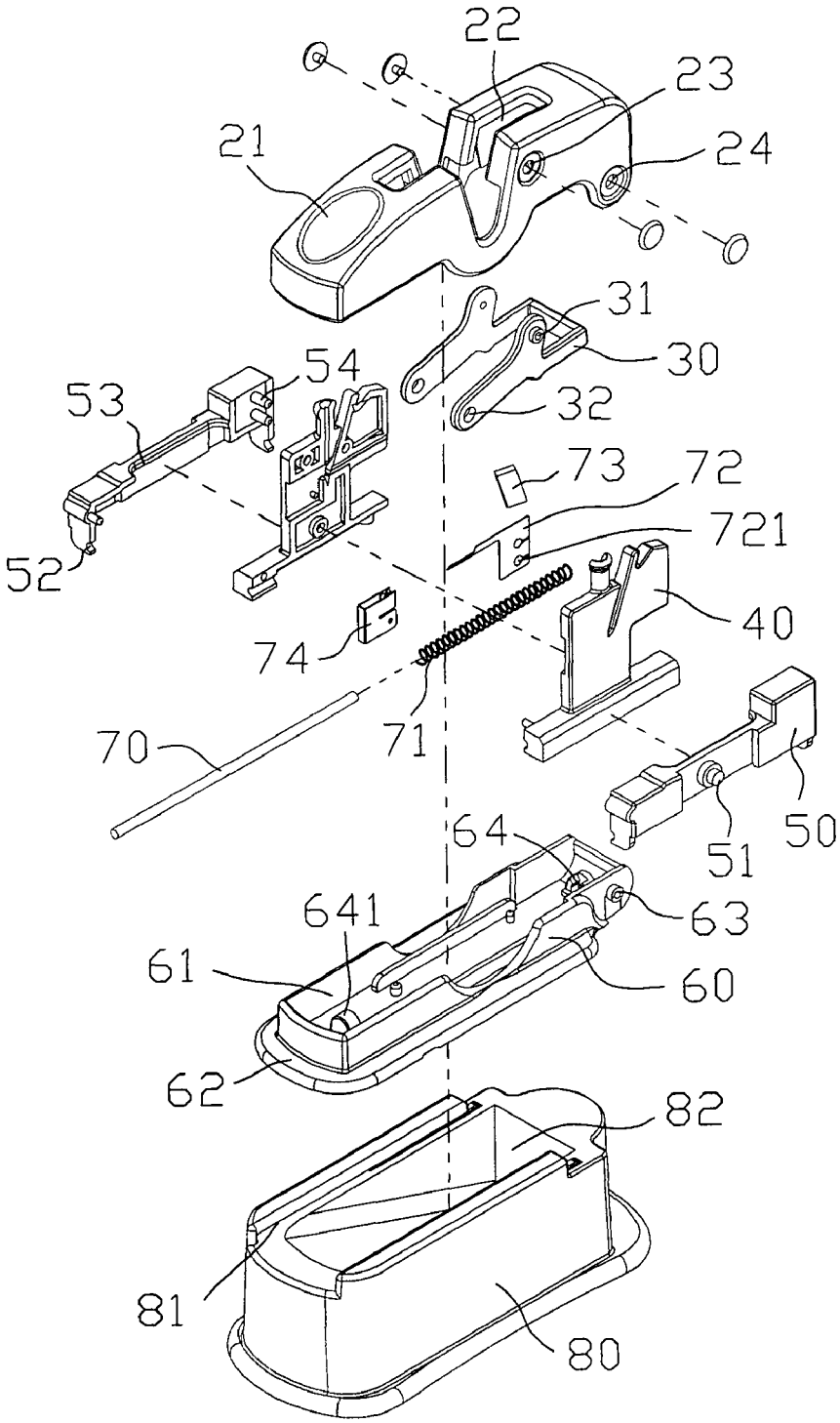
FIG. 3 shows an exploded view of the present invention.
Figure 4:
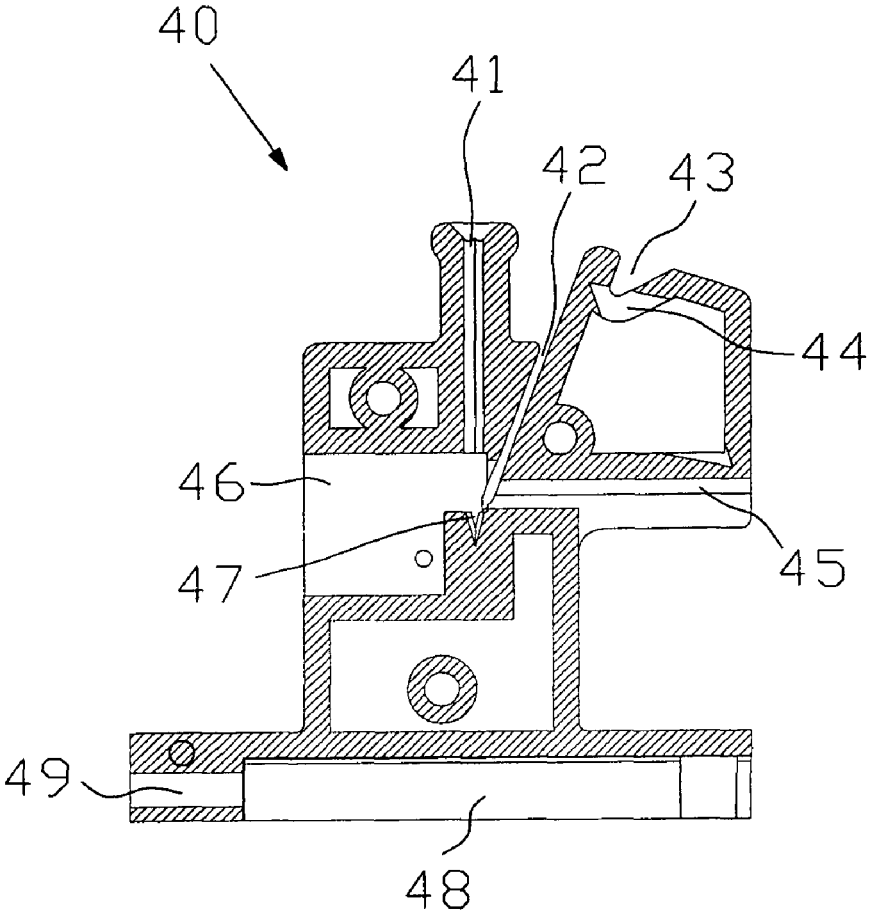
FIG. 4 shows a sectional view of the needle stand of the present invention.

Referring to FIGS. 2~4, the threader 20 of the present invention comprises: an upper holder block 21, a brake 30, a needle stand 40, a propeller 50, a base 60 and a detachable pedestal 80; an orifice 22 is arranged at central section of the upper holder block 21, and two holes 23, 24 at rear-end of both sides; a snapper 31 is arranged at central section on both sides of the brake 30, and a hole 32 on the front section; the needle stand 40 is provided with an adapting hole 41, a wiring duct 42, a notch 43, a blade hole 44, a threading groove 45, a V-shaped groove 47, a trough 46, a limitation slot 48 and a through-hole 49; of which, the blade hole 44 is provided with an embedded blade 73, and the trough 46 with a clamping slot 74; the propeller 50 is fitted with a snapper 51 at left and right sides, and a through-hole 52 under front and rear sides, whilst the joint pin 54 at rear end is used for penetrating into the punch hole 721 of the threading sheet 72, so that the threading sheet 72 is fixed at rear end of the propeller 50; a holding groove 61 is placed centrally on the base 60; a spacer 64, 641 is arranged at front and rear ends within the holding groove 61, a snapper 63 arranged externally on both sides of the rear end, and a flange 62 arranged peripherally at the bottom; at the top of the detachable pedestal 80, an inner space 82 with oblique surface is opened downwards, and a sliding slot 81 is arranged at both sides on the top of the inner space 82.

The propeller 50 and needle stand 40 are structurally mounted into the holding groove 61 of the base 60, and the needle stand 40 is covered by the propeller 50, while the needle stand 40 is protruded into the orifice 53 of the propeller 50; additionally, an orientation pin 70 is placed on the spacer 64, 641 of the base 60; the orientation pin 70 is also inserted into the through-hole 49, 52 of the needle stand 40 and propeller 50; moreover, a restoring spring 71 is sleeved onto the limitation slot 48 of the needle stand 40; the upper holder block 21 allows the hole 24 to be adapted with the snapper 63 of the base, while the other hole 23 of the upper holder block 21 is locked with the snapper 31 of the brake 30, and the hole 32 at front of the brake 31 is locked into the snapper 51 at both sides of the propeller 50; the detachable pedestal 80 allows the flange 62 of the base 60 to be accommodated through the sliding slot 81.

Figure 5:
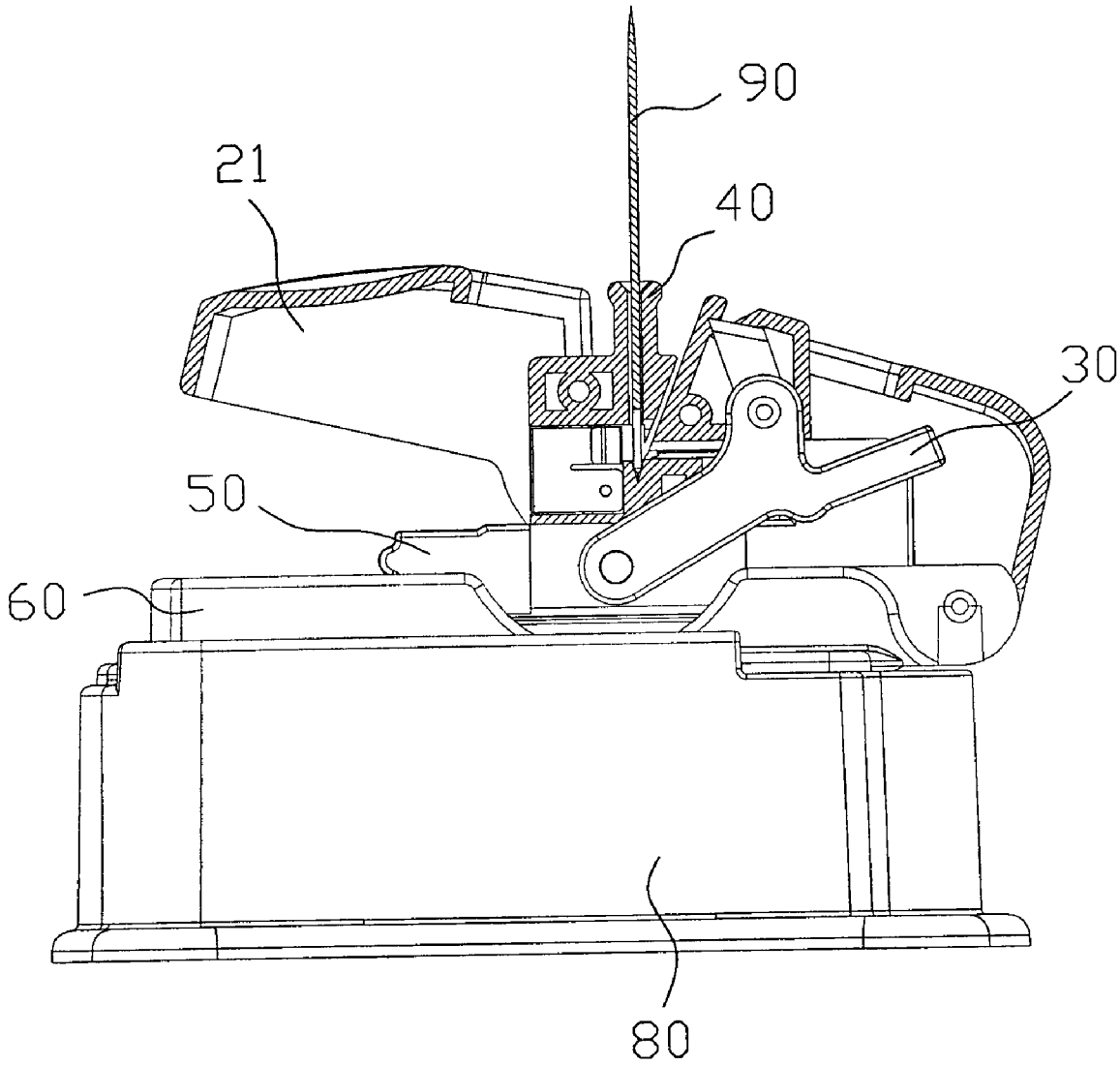
FIG. 5 shows a view of the preferred embodiment of the present invention.
Figure 6:
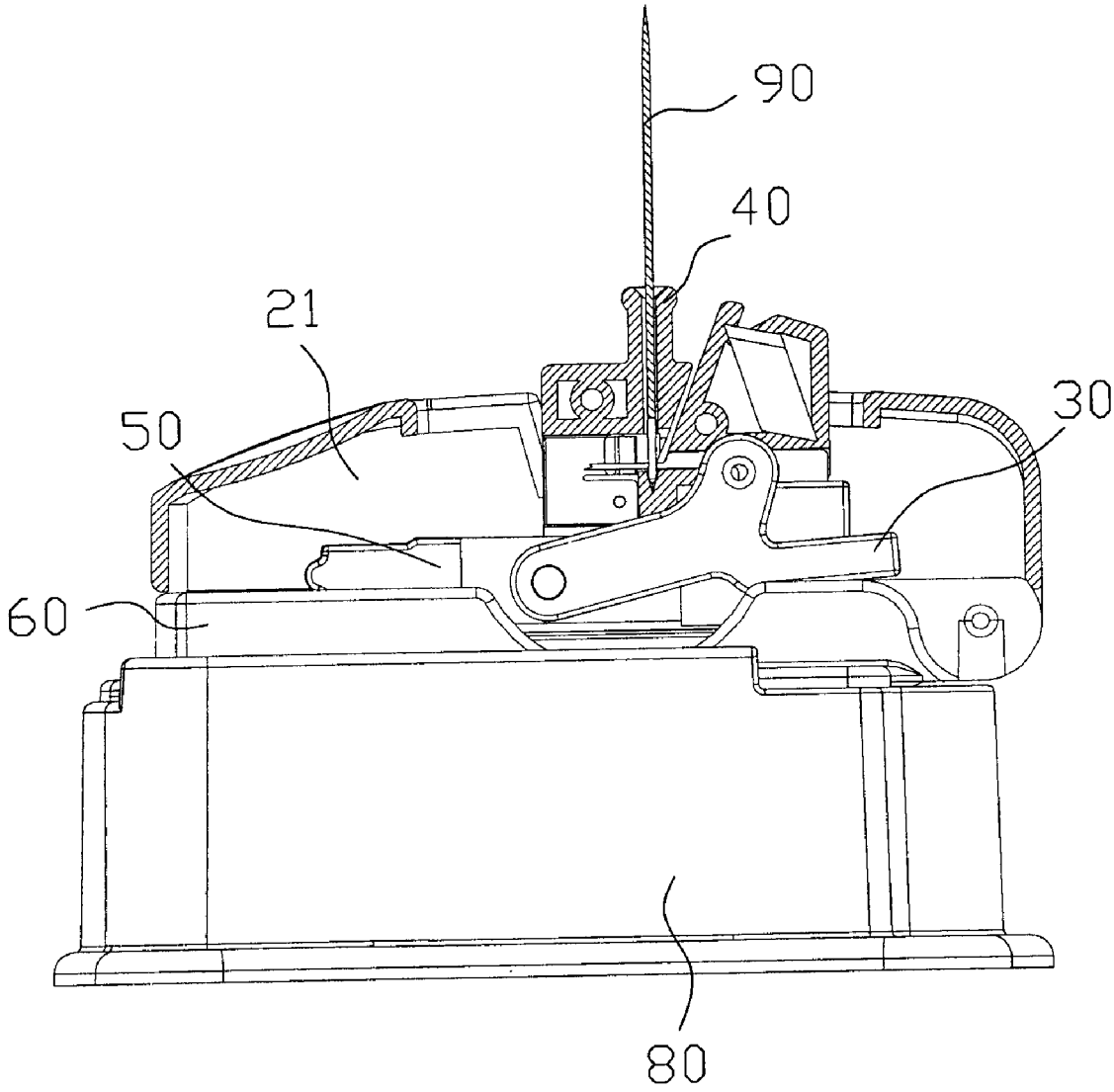
FIG. 6 shows another view of the preferred embodiment of the present invention.

Referring also to FIGS. 5 and 6, the interactive relation between the brake 30 and the propeller 50 is illustrated; when the threader 20 is under ready state, the propeller 50 is supported and positioned at the rear end of the base 60 by the restoring spring 71; when the upper holder block 21 presses down, the brake 30 drives the propeller 50 to move forwards; contrarily, when the upper holder block 21 releases its pressing action, the propeller 50 moves backwards via the restoring spring 71, and drives the brake 30 and upper holder block 21 for resetting.

Figure 7:
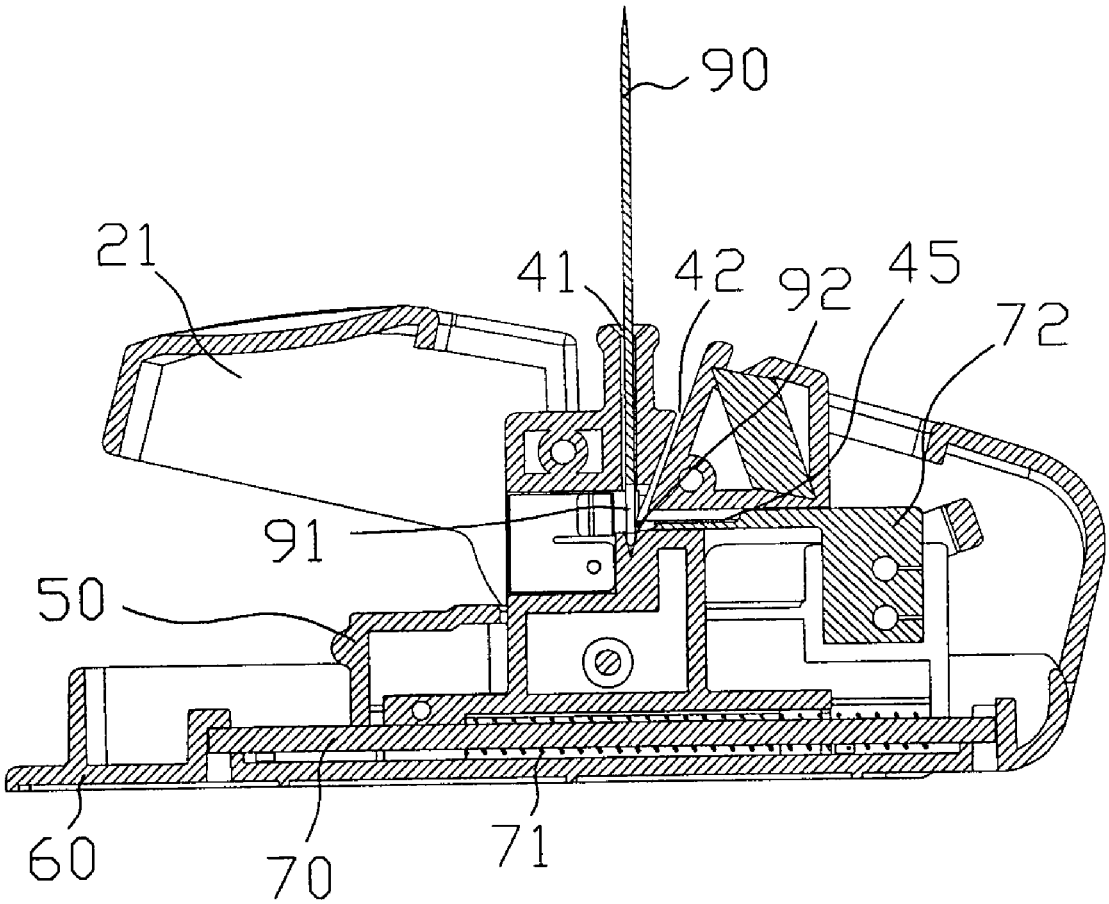
FIG. 7 shows a sectional view of the preferred embodiment of the present invention.
Figure 8:
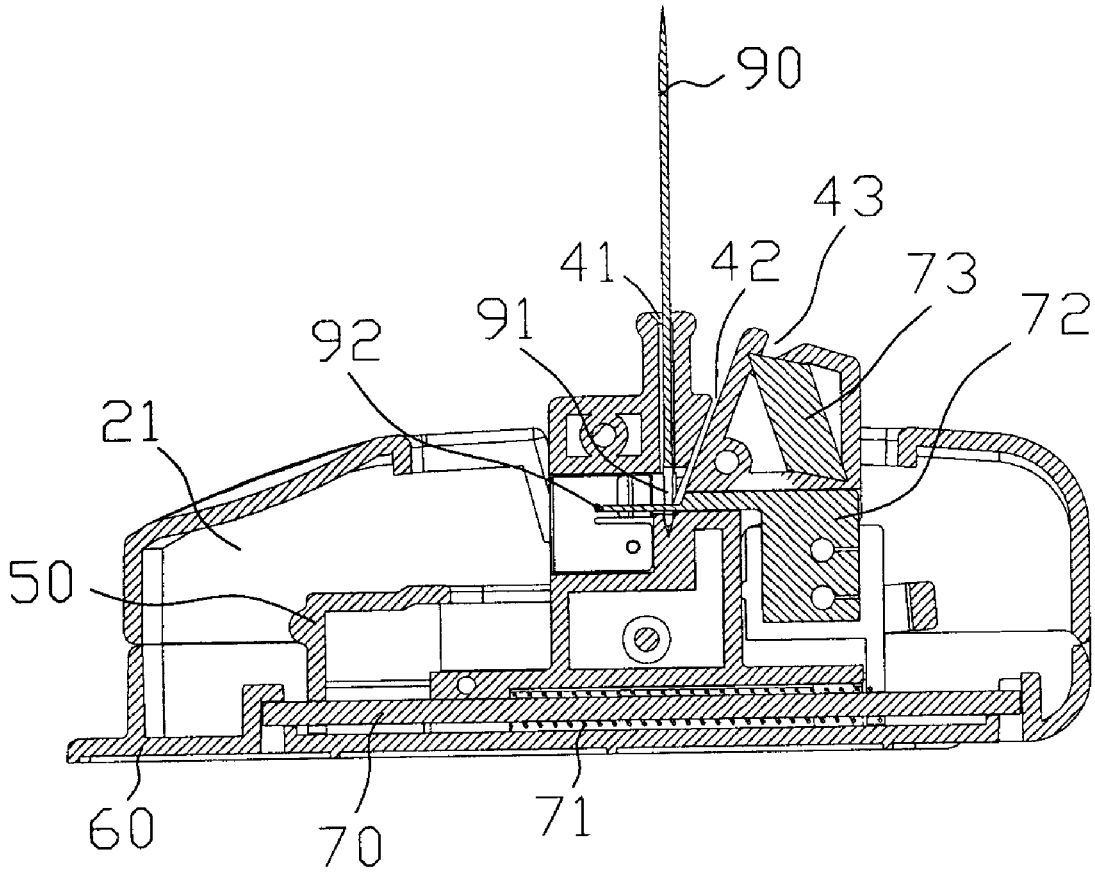
FIG. 8 shows another sectional view of the preferred embodiment of the present invention.

Referring also to FIGS. 7 and 8, the wiring duct 42 of the needle stand 40 is connected with the bottom of the adapting hole 41, and V-shaped groove 47 at the bottom of the adapting hole 41 enables the needle 90 to be inserted into the adapting hole 41, and then aligns automatically the needle hole 91 with the threading groove 45; after the stitch 92 is inserted through the wiring duct 42, the threading sheet 72, stitch 92 and needle hole 91 are positioned at the same linear location; in such case, if users press down the upper holder block 21, the threading sheet 72 can be driven to push the stitch 92 for passing through the needle hole 91; furthermore, the blade 73 on the blade hole 44 allows the user to cut off the redundant stitch 92 through the notch 43.

Figure 9:
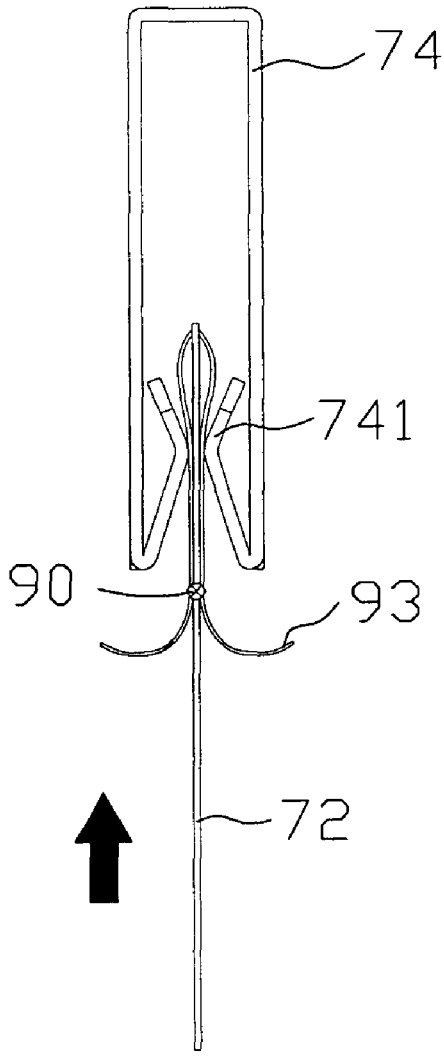
FIG. 9 shows threading view 1 of the present invention.
Figure 10:
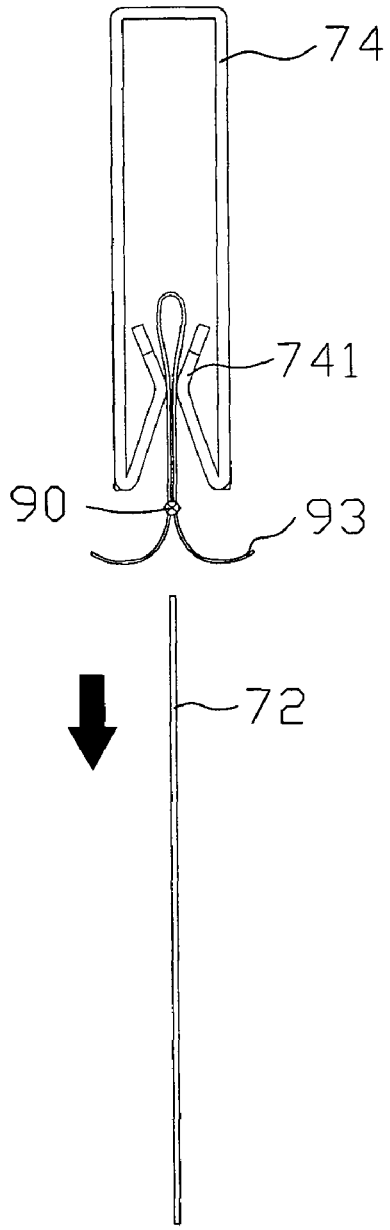
FIG. 10 shows threading view 2 of the present invention.

Referring also to FIGS. 9 and 10, after the threading sheet 72 pushes the stitch 92 to pass through the needle 90, it also allows to penetrated into the clamping portion 741 of the clamping slot 74; after the threading sheet 72 is reset, a proper length of the stitch 92 is reserved by the clamping portion 741, thus preventing the stitch 92 from disengaging from the needle hole 91 when the needle 90 is removed.

Figure 11:
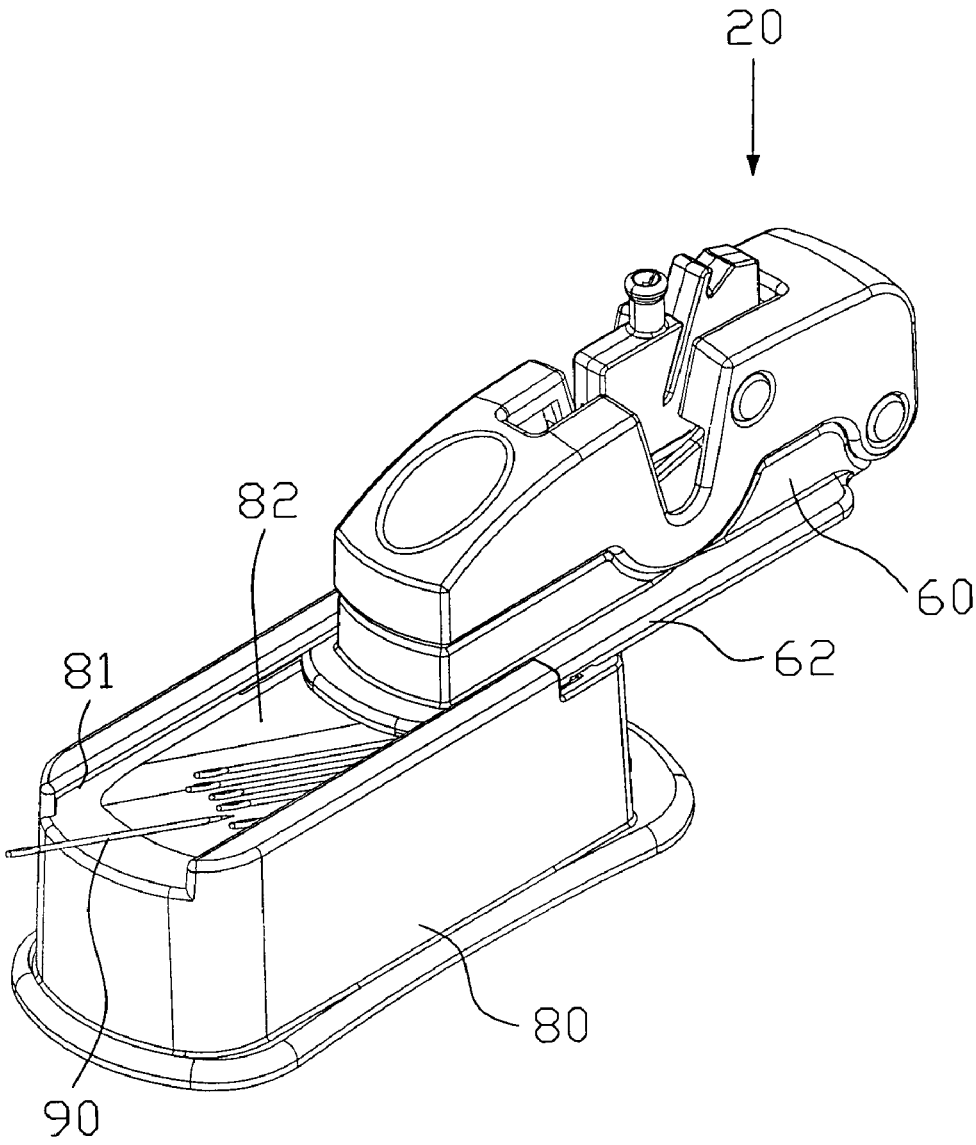
FIG. 11 shows application view 3 of the present invention.

Referring also to FIG. 11, the inner space 82 of the detachable pedestal 80 is used to accommodate the needle 90 or stitch 92 for easy access.

What is claimed is:

1. A detachable threader, which comprising:

an upper holder block, where an orifice is arranged at its central section, and two holes arranged at rear-end of both sides;

a brake, where a snapper is arranged at central section on both sides of the brake, and a hole on the front section; the snapper is locked with the hole of the upper holder block;

a needle stand, which is penetrated into the orifice of the upper holder block, provided with an adapting hole, a wiring duct, a notch, a blade hole, a threading groove, a V-shaped groove, a trough, a limitation slot and a through-hole, of which the blade hole is provided with an embedded blade, and the trough with a clamping slot;

a propeller, which is covered on both sides of the needle stand; the needle stand is protruded into the orifice of the propeller, and a snapper is arranged at left and right sides for locking with the hole of the baser; a through-hole is arranged under front and rear sides, and the joint pin at rear end is used for penetrating into the punch hole of the threading sheet;

a threading sheet, which is fixed at rear end of the propeller, and allowed to move freely in the threading groove of the needle stand;

a base, where a holding groove is placed centrally to accommodate the propeller and needle stand; a spacer is arranged at front and rear ends within the holding groove, a snapper is arranged externally on both sides of the rear end for locking with the hole of the upper holder block, and a flange is arranged peripherally at the bottom;

a detachable pedestal, at top of which an inner space with oblique surface is opened downwards, and at both sides on the top of which a sliding slot is arranged;

an orientation pin, which is placed on the spacer of the base, and also inserted into the through-hole of the needle stand and propeller;

a restoring spring, which is sleeved onto the limitation slot of the needle stand;

when the upper holder block presses down, the brake drives the propeller so that the threading sheet on the brake could move forwards within the threading groove of the needle stand, enabling the stitch to penetrate into the needle hole, whilst the inner space of the detachable pedestal is used to accommodate the needle and stitch.

2. The device defined in claim 1, wherein V-shaped groove is arranged at the bottom of the adapting hole.

3. The device defined in claim 1, wherein the wiring duct of the needle stand is connected with the bottom of the adapting hole.

4. The device defined in claim 1, wherein the detachable pedestal allows the flange of the base to be accommodated through the sliding slot.

5. The device defined in claim 1, wherein the clamping portion of the clamping slot and the threading sheet positioned at the same linear location.

6. The device defined in claim 1, wherein the blade onto the blade hole is partially exposed in the notch of the needle stand.

* * * * *